US005439016A

United States Patent [19]

Grahn

[11] Patent Number: 5,439,016

[45] Date of Patent: Aug. 8, 1995

[54] TENT AND METHOD FOR PITCHING THEREOF

[76] Inventor: Bengt Grahn, Abmorvägen 47, Moskosel, S-930 86, Sweden

[21] Appl. No.: 133,062

[22] PCT Filed: Apr. 2, 1992

[86] PCT No.: PCT/SE92/00209

§ 371 Date: Apr. 4, 1994

§ 102(e) Date: Apr. 4, 1994

[87] PCT Pub. No.: WO92/18729

PCT Pub. Date: Oct. 29, 1992

[30] Foreign Application Priority Data

Apr. 9, 1991 [SE] Sweden ..... 9101047

[51] Int. Cl.[6] ..... E04H 15/24; E04H 15/34

[52] U.S. Cl. ..... 135/100; 135/121; 135/123; 135/130; 135/132; 135/135; 135/905; 135/908

[58] Field of Search ..... 135/100, 101, 905, 908, 135/96, 103, 907, 130, 121, 123, 132, 135

[56] References Cited

U.S. PATENT DOCUMENTS

| | | | |
|---|---|---|---|
| 645,890 | 3/1900 | Conrad | 135/908 X |
| 2,302,650 | 11/1942 | Anderson et al. . | |
| 3,176,698 | 4/1965 | Warner . | |
| 4,838,292 | 6/1989 | Allen . | |
| 5,036,874 | 8/1991 | Lynch | 135/905 X |

FOREIGN PATENT DOCUMENTS

| | | | |
|---|---|---|---|
| 0725425 | 1/1966 | Canada | 135/100 |
| 1159434 | 6/1958 | France | 135/100 |
| 0732709 | 6/1955 | United Kingdom | 135/100 |

*Primary Examiner*—Carl D. Friedman
*Assistant Examiner*—Wynn E. Wood
*Attorney, Agent, or Firm*—Zarley, McKee, Thomte, Voorhees, & Sease

[57] ABSTRACT

A substantially cone-shaped tent comprises a plurality of rods connected to each other in the region of the top of the tent and arranged to extend divergingly downwardly to the ground on which the tent stands and bear thereagainst while each forming substantially a generatrix of an imagined cone, a substantially cone-shaped tent cloth adapted to bear on the outside of and be carried by the rods, and means adapted to interconnect adjacent rods at a distance from the top of the tent so as to hold them in a determined mutual position. Said interconnecting means comprise elongated rigid elements with a first engaging member at each end thereof, and the rods have second engaging members arranged to enter into engagement with the first engaging members arranged on the corresponding rigid elements when connecting adjacent rods by means of the rigid elements and by that hold two adjacent rods at a mutual distance defined by the rigid element.

11 Claims, 6 Drawing Sheets

TENT AND METHOD FOR PITCHING THEREOF

FIELD OF THE INVENTION AND PRIOR ART

The present invention relates to a substantially cone-shaped tent and a method for pitching such a tent according to the appended independent product and method claim, respectively.

Example of this type of tents are huts and tepees and it is of course a desire to be able to rapidly pitch and disassemble them, so that it is possible to use them also in occasional arrangements, such as pitch a camp for one single night or for any activity for one day or a part thereof.

The invention relates in particular but not exclusively to the larger so called "giant tent huts", which may have a top height and base diameter rather often of 7 and 10 meters, respectively. The cone-shaped tents hitherto known of this order of magnitude require too much time to pitch and disassemble in order to make it reasonable to use them for more occasional or temporary arrangements. First of all it is required to tie the rods diverging downwardly towards the ground and supporting the tent cloth at the top so as to interconnect them, which is delicate to achieve in an appropriate manner, so that they are well held together also after the pitching. The rods are tied together after the very erection, but this is for natural reasons bothering. Is thereby the conventional technique utilized, so that the rods cross each other just below the upper end thereof for obtaining the top bunch characteristic for huts, it will then be extremely difficult to afterwards get the tent cloth over the top, should a tent cloth completely sewn up be used, so that it will be necessary to make the tent cloth cone brokable by buttons, zipfastener or the like, and this makes of course the cloth weaker. Also when such a characterizing bunch or top cross is omitted it will be too difficult to get a tent cloth with substantially the form of a continuous cone in place by means of known techniques on huts being so high and when the tent cloth weight is so considerable that may sometimes be the case. Another disadvantage of the tents of this kind hitherto known consists in that the means necessary for interconnecting adjacent rods may not be applied in a sufficiently rapid and secure way, since they generally are made of cross bars which have to be tied at the respective ends thereof to the rod in question.

BRIEF DESCRIPTION OF THE INVENTION

The object of the present invention is to provide a tent and a method for pitching thereof of the kind mentioned in the introduction, which enable a more rapid and at the same time also easier and more secure pitching and disassembling of such a tent, so that it will be motivated to use even larger such tents, such as so called "giant tent huts" for temporary arrangements.

This object is obtained in accordance with the invention by providing a tent and a method for pitching thereof according to the appended product and method claims.

Thanks to the fact that according to a feature of the invention the means in question adapted to interconnect adjacent rods comprise elongated rigid elements with first engaging members and the rods have second engaging members fitting therewith, it will accordingly be possible to rapidly and easily after the erection of the rods interconnect these, so that they occupy the desired positions defined for supporting and stretching the tent cloth and securely maintain these positions. This leads to a considerable saving of time and improvement of the accuracy with respect to the tying method used before.

According to a second preferred embodiment of the invention the tent comprises members for pivotally connect the upper end of each rod to a frame of a support arrangement in the region of the top of the tent, said frame being intended to be arranged substantially horizontally and each rod is pivotable substantially about the horizontal tangent of the frame in connection points between the rods and the frame when the frame is directed horizontally. Thanks to these characteristics the rods may be interconnected when the tent top is located low, preferably on the ground, and the tent top may thereafter be brought upwardly while pivoting the lower ends of the rods in the direction towards each other until the desired divergence is obtained. The rods will also in the pitched position be safely connected to each other through said frame. Thus, in the definition "connected to each other" or "interconnected" in the claims an indirect connection is also comprised such as in this case obtained by the frame.

According to a further preferred embodiment of the invention the support arrangement of the tent mentioned above comprises a support element rigidly connected to said frame, said support element being arranged under the frame and designed with an outer circumference arranged to be touch by and support the respective rod extending from the frame and downwardly towards the ground, when the rods are in the determined mutual position for interconnection by means of the rigid elements. This enables a rapid obtension of the divergence of the rods desired, since a straight line running between the outer periphery of the frame and the support element forms a generatrix of an imagined cone created by the inner side of the rods in the desired position, and the rods have only to be pivoted so that they come into abutment on the outside of the support element, but the support element has above everything also the advantage that it owing to the abutment of the rods thereagainst from different directions removes every risk for tilting of the support arrangement and by that improves the stability of the tent considerably.

Further characteristics being of help for making the pitching and disassembling of the tent of the type in question more rational are defined in the other dependent claims and in the description following hereafter, a particularly advantageous embodiment of the method according to the invention comprising features enabling an easy and rapid application of the tent cloth.

BRIEF DESCRIPTION OF THE DRAWINGS

With reference to the appended drawings, below follows a specific description of a preferred embodiment of the invention cited as an example.

In the drawings.

DETAILED DESCRIPTION OF A PREFERRED EMBODIMENT OF THE INVENTION

Figure 1:
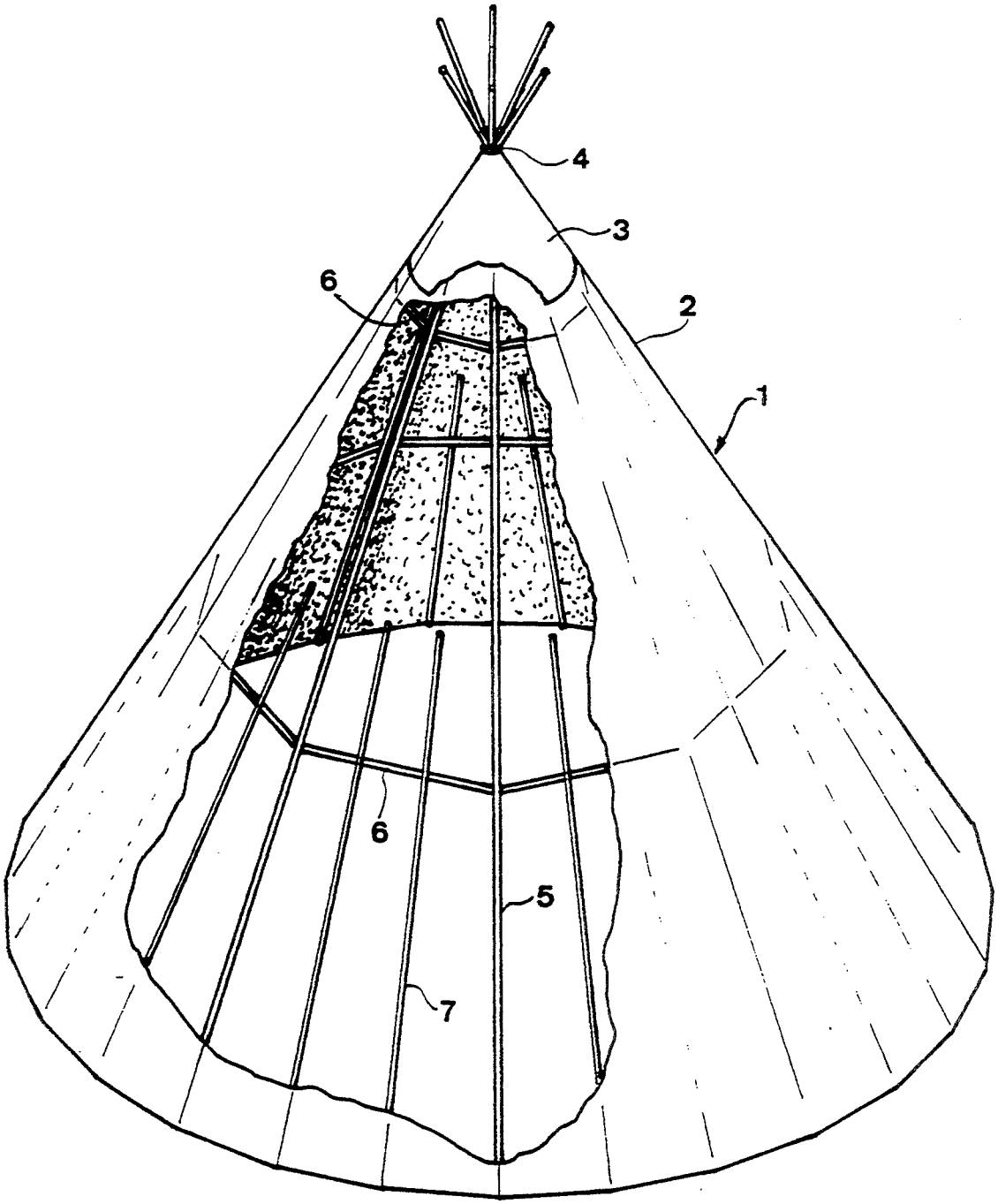
FIG. 1 simplified perspective view of a tent according to the invention, in which a part of the tent cloth has been broken away for illustrating the construction of the tent.

A tent 1 according to the invention of the type "giant tent hut", which in this case in the reality is meant to have a height of about 7 meters and a base diameter of about 10,2 meters, as schematically shown in FIG. 1. The tent 1 has a substantially cone-shaped tent cloth 2, which has an upper opening not visible here for discharging flue gases when making a fire in the tent. Said opening is in the state shown in FIG. 1 covered by a flue gas fly or valve 3 which consists of a substantially cone-shaped cloth hanging from the top 4 of the tent and which may be hoisted by means not shown or closer described here for exposing a desired part of said flue gas opening.

Furthermore, the tent has a stand for supporting and stretching the tent cloth 2, said stand comprising as main components rods 5 connected to each other in the region of the top of the tent and extending divergingly downwardly to the ground on which the tent stand and bear thereagainst, each such rod substantially forming a generatrix of an imagined cone. The rods 5 are interconnected by elongated rigid elements 6, hereafter called cross bars, which in the tent shown are arranged on two different levels around the tent. It will by means of FIG. 4 later on be explained how the adjacent rods 5 is coupled to each other by means of the cross bars 6. Further supporting or carrying elements 7 in the form of long pins are arranged between two adjacent rods 5 and to extend from the ground and upwardly in the direction of the top of the tent while bearing on the outside of the cross bars, and they are terminated a little bit above the lower cross bars.

The construction of the tent according to the invention will now be explained more in detail while describing how the tent is pitched, a disassembling of the tent being intended to take place in substantially inverted order of the working moments should not the contrary be expressed.

Figure 2:
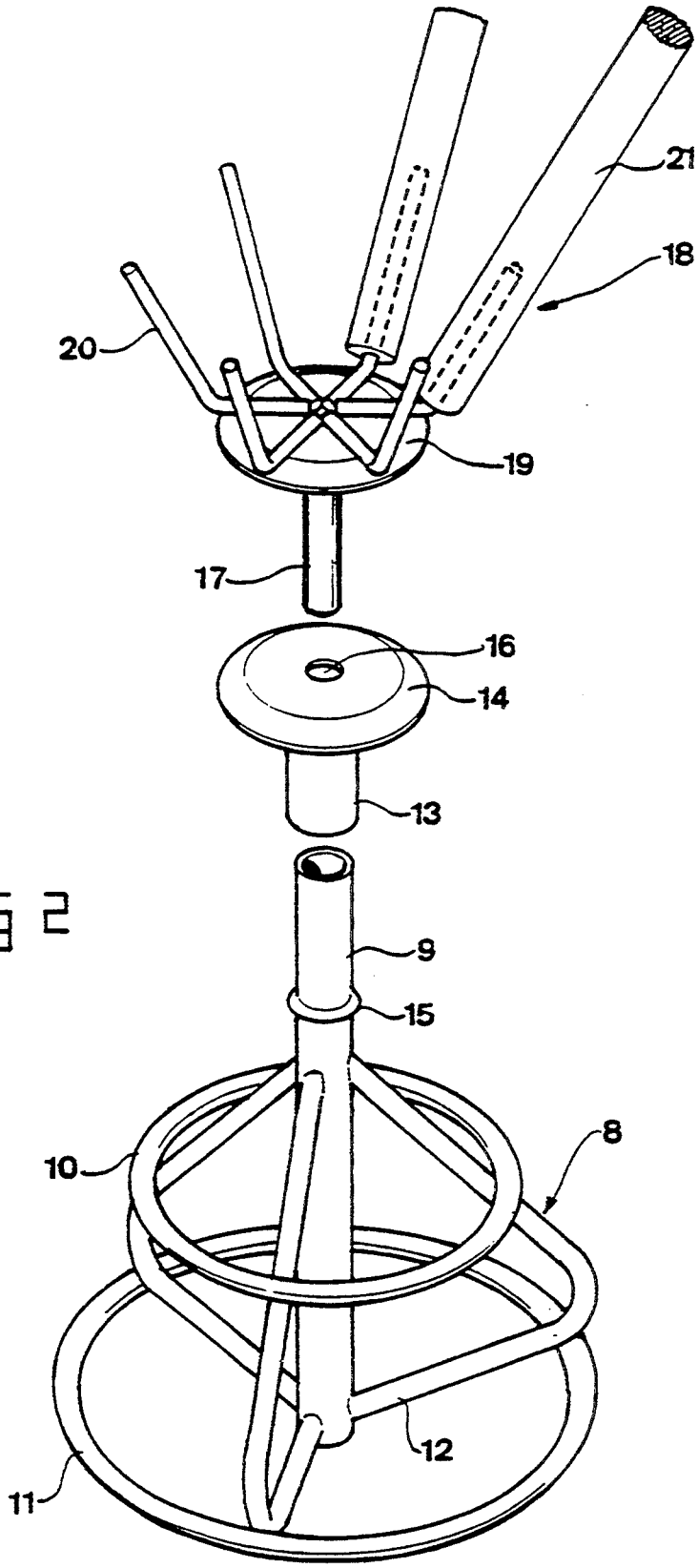
FIG. 2 is an exploded perspective view illustrating a support arrangement being a part of the tent according to FIG. 1 for holding the rods together in the top of the tent.
Figure 3:
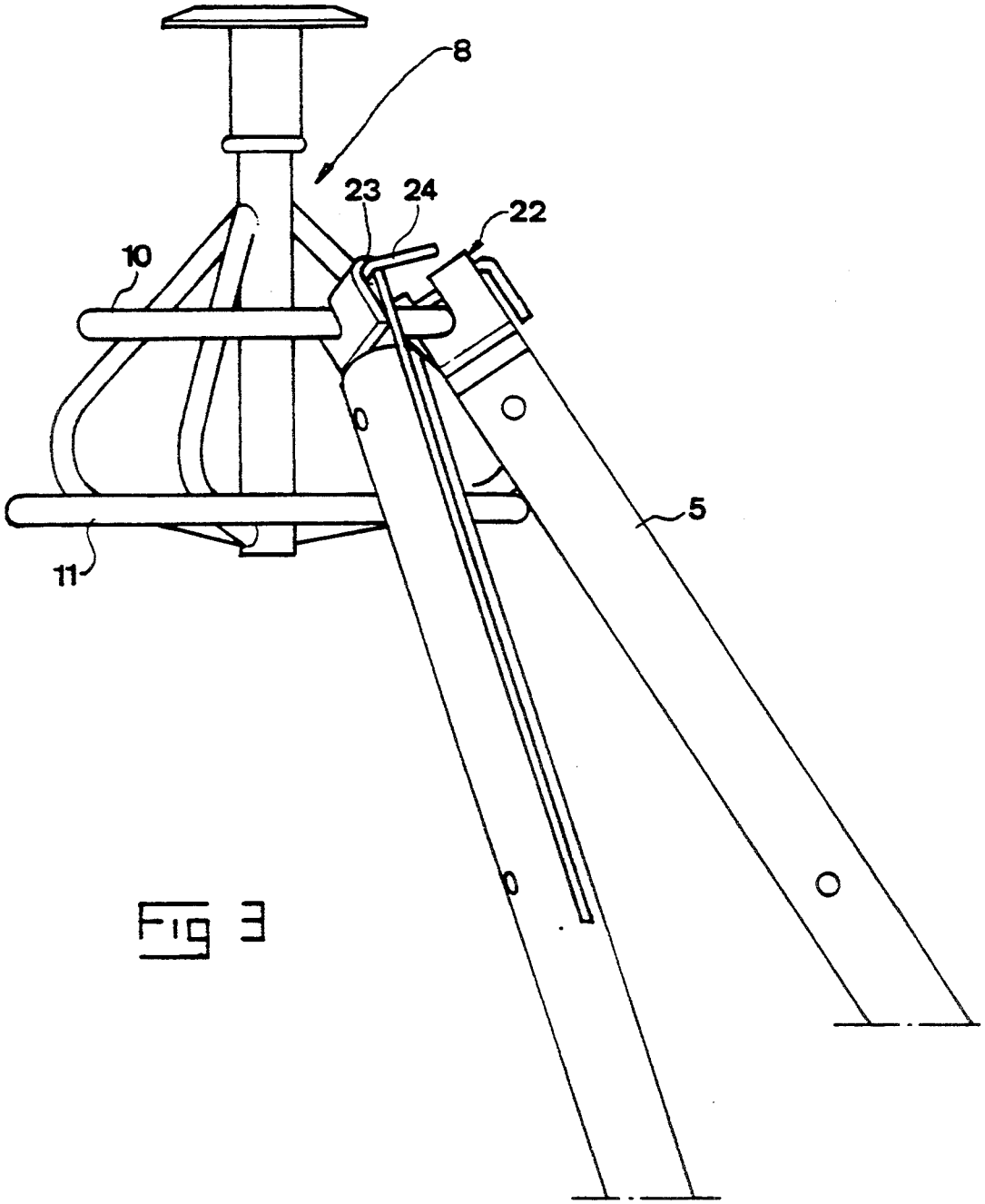
FIG. 3 is a side elevation of the support arrangement according to FIG. 2, which illustrates how the rods are connected thereto.

Reference is now made to FIG. 2 and 3 for explaining the top construction of the tent. The tent comprises a support arrangement 8, which is made of a central tube 9, which is intended to be arranged so that is extends substantially in correspondence with the height axis of the tent cone, and rings 10, 11 arranged on different levels around this tube, which are rigidly connected to the tube through three bars 12. The surface circumscribed by the respective ring is substantially perpendicular to the extension of the tube 9 and the rings are concentrically arranged with respect thereto. The upper, first ring 10 has a diameter which is smaller than the lower. A sleeve 13 with a substantially circular top plate 14 may be pushed over the tube 9 and bear on an annular flange 15 on the tube. The plate 14 is adapted to function as a support flange for supporting the upper part of the flue gas fly 3 thereon. An opening 16 is arranged in the centre of the plate 14 for receiving a pin 17 of a bunch construction 18. The pin 17 is secured to the underside of the plate 19, the underside of which has a shape complementary to the upper side of the plate 14, but spacer members are arranged so as to keep the plates away from each other for enabling turning of the flue gas fly. Six rods 20, preferably of metal, are secured on the upper side of the plate 19 and bent outwardly-upwardly. The rods 20 are evenly distributed along the plate 19 and a wood pin 21 having a length of about 1 m and with a centre bore for receiving the respective rod 20 is pushed onto each of the rods. Only two wood pins 21 are shown in FIG. 2 for the sake of clearness, but such pins shall be arranged on all rods 20 and they shall be longer than the both shown in the Figure. Members not shown, such as strings, are preferably winded around the pins 21 at the lower end thereof so as to anticipate a formation of cracks in the pins in the region of the rod bores. The pins 21 are so directed that they in the state applied on the support arrangement 8 together form a bunch dummy and seem to constitute a prolongation of the rods 5, such as in conventional huts, i.e. the pins 21 constitute prolongations of the generatrixes of the cone described by the tent cloth. In this way it is possible to obtain a hut with a traditional appearance, but in spite thereof apply a flue gas fly and easily apply the tent cloth without being disturbed by the bunch, since this is applied afterwards.

It is shown in FIG. 3 how the rods 5 are intended to be connected to each other by an indirect interconnection through the support arrangement 8. The upper end of the respective rod is provided with a U-shaped member 22, the two legs of which are intended to be pushed beyond the first ring 10, so that this is received in the bottom of the U. Furthermore, the legs of the U have at the upper ends thereof an opening 23 each for receiving a locking pin 24 interconnecting the legs, which together with the legs of the U are arranged to hold the upper end of the rod in place at the ring 10. The U-shaped member 22 is formed by securing a flat iron in the rod 5 and bending it in the way shown in FIG. 3. By pushing the ends of the rods onto the ring 10, so that this is received between the legs of the respective U and after that introducing the locking pin 24 obliquely from above, the rods 5 may be rapidly and easily connected to the support arrangement 8. This connection makes it possible to pivot the rods 5 about the tangent of the ring in the connection point in question. It is at the same time possible to displace the rods along the rings. The diameter of the second ring 11 are chosen so that the rods 5 bear on the outside thereof on assuming the desired divergence degree from the top of the tent and downwardly towards the ground. When pitching the tent all rods 5 may by that first be applied evenly distributed around the first ring 10 and the rods after that be pivoted with their lower ends towards the future centre of the tent while lifting the support arrangement 8 until they come to bear against the second ring 11. A possible readjustment may take place thereafter. The ring 11 ensures in this way also that the support arrangement 8 may not tilt, since the rods 5 bear from different directions against the second ring.

Figure 4:
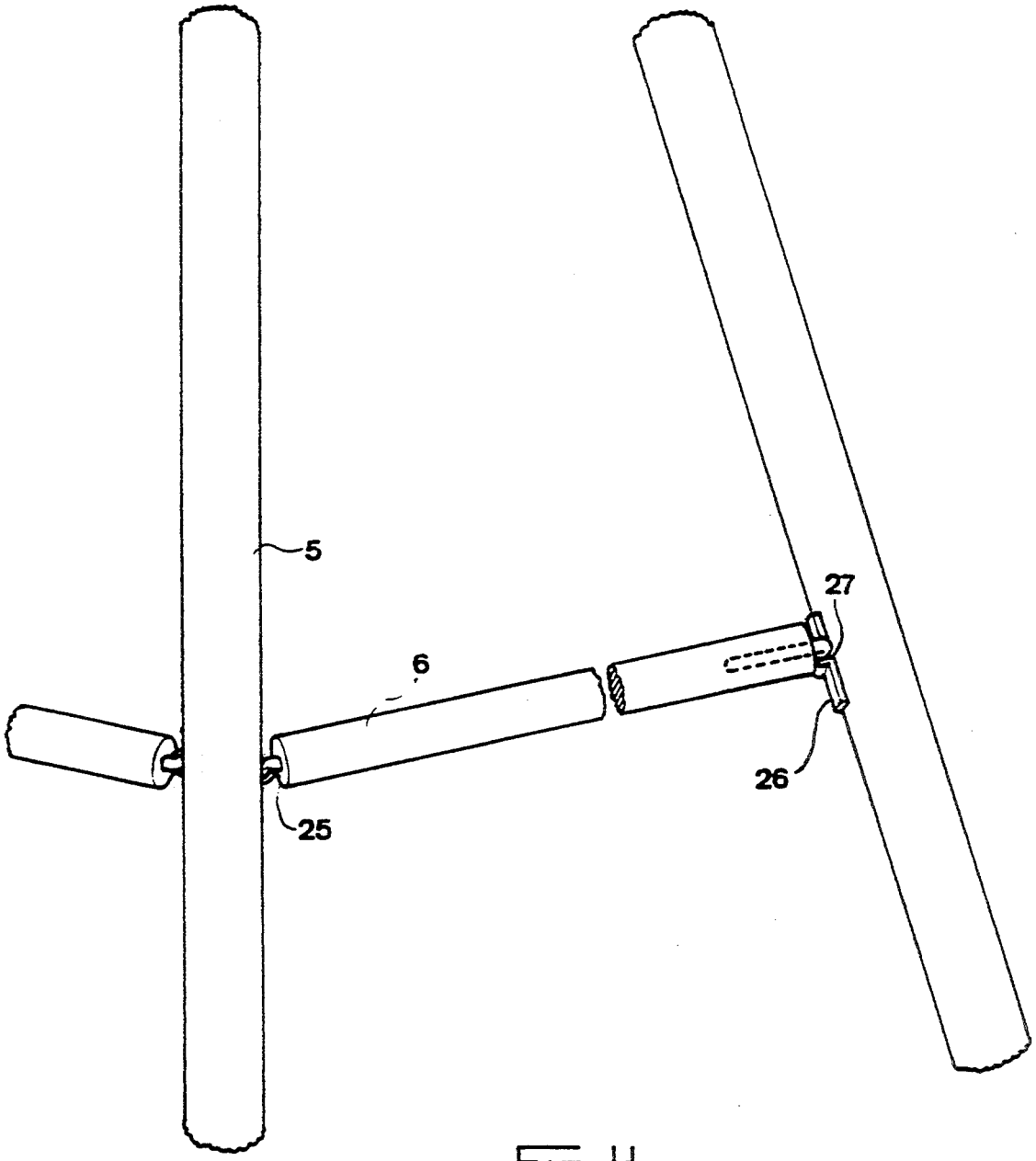
FIG. 4 is a detailed view illustrating how the interconnection of two adjacent rods takes place in a tent according to FIG. 1.

After the pivoting just described of the rods 5 to the desired position the cross bars 6 shown in FIG. 1 are applied on two different levels between the adjacent rods, and how this is carried out is described more in detail in FIG. 4. The cross bar 6 has at each end a male member 25 directed substantially perpendicularly to the longitudinal direction of the bar in the form of an extension. A loop 26 is arranged on the side of each rod intended to face the adjacent rod, said loop defining a female member 27 for receiving an extension 25 of the cross bar 6. The two extensions of the cross bar 6 are preferably directed parallelly with each other and the loop is arranged with the female opening thereof directed substantially perpendicularly to the longitudinal direction of the rod, so that at erected rods diverging downwardly an introduction of the extensions 25 therein may take place obliquely from above-from outside and downwardly-inwardly towards the inner of the tent and the gravitation tends by that to keep the cross bar 6 in place. Thus, the cross bars 6 may be applied at a high frequence, since the extensions 25 only have to be pushed into the loop openings 27 and the interconnnection of adjacent rods 5 is completed thereafter, in which some small readjustment of the rods 5 after their pivoting upwardly may be required so as to make the cross bar 6 to fit therein, and this readjustment is easily possible thanks to the movable arrangement of the rods 5 in the support arrangement 8. The application of the cross bars 6 will lead to an alignment of the support arrangement 8, so that the tube 9 points towards the centre of the base of the tent, and it may after that not leave this aligned position thanks to the abutment of the rods 5 therearound.

Figure 5:
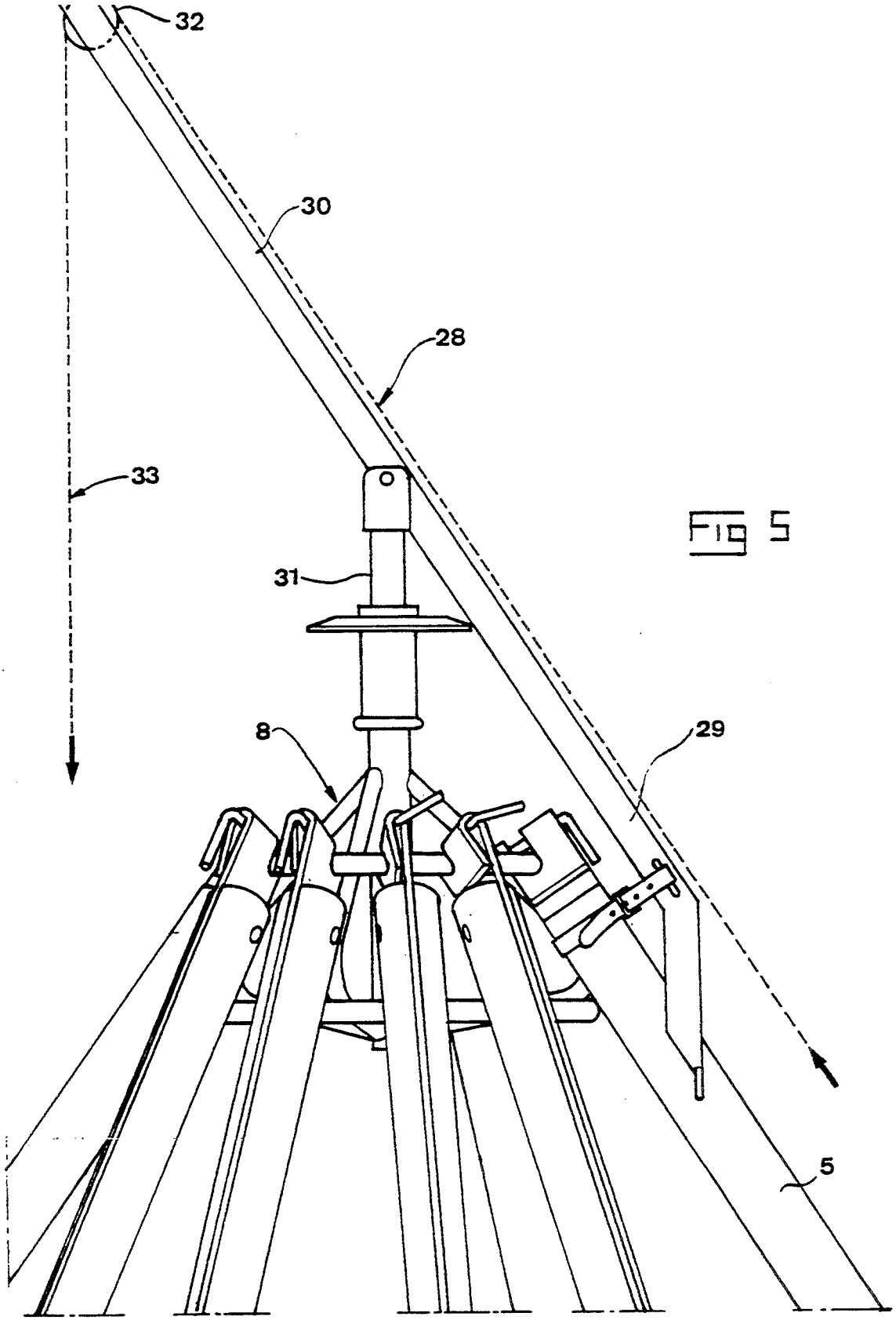
FIG. 5 is a side elevation showing a tool applicable in the top of the tent according to FIG. 1 for bringing the tent cloth onto and also pulling the tent cloth off the stand defined by the rods.
Figure 6:
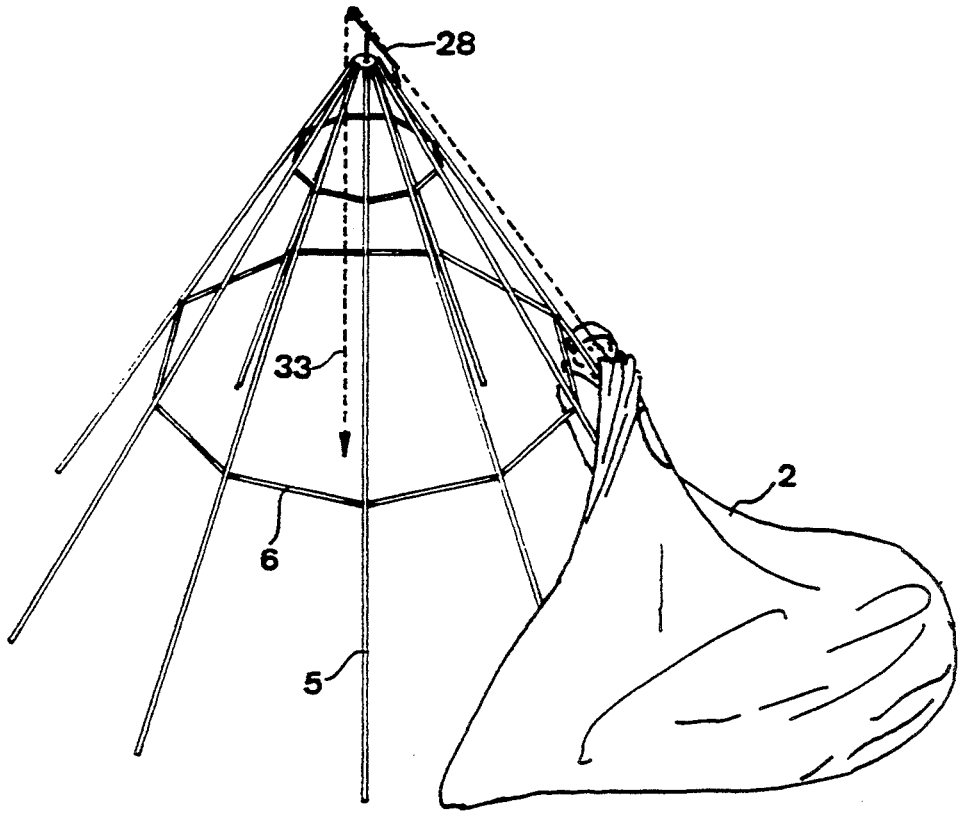
FIG. 6 shows in perspective the initial face of an hoisting of a tent cloth by means of the tool shown in FIG. 1.
Figure 7:
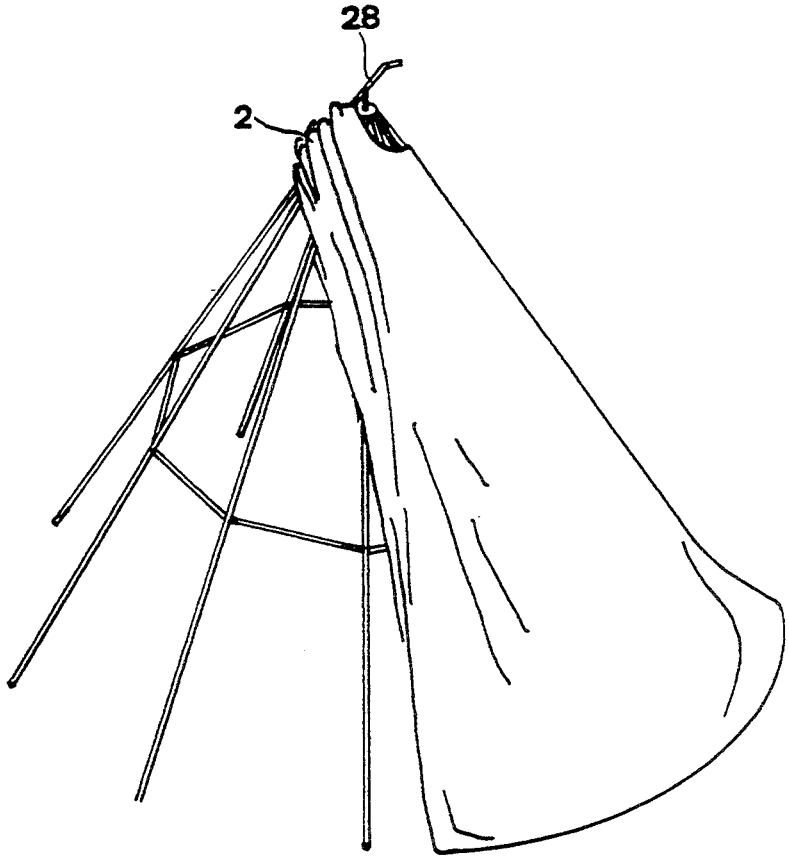
FIG. 7 shows a view corresponding to FIG. 6 in a later phase, in which the tent cloth has been brought to pass the top of the stand.

The moments of the pitching of the tent so far described may be carried out in a comparatively short period of time, and the thing now remaining is substantially only to bring the tent cloth in place, and this is preferably carried out by means of a cloth hoist tool 28 illustrated in FIG. 5, which may be applied on the top of the support arrangement 8 before lifting it by pivoting the rods 5. The cloth hoist or elevating tool 28 consists of a double-armed lever with a first 29 and a second 30 arm, which is pivotably arranged at a post 31, which is designed to fit in the tube 9 of the support arrangement through the opening 16. A diverting member 32 in the form of a wheel is arranged at the outer end of the second arm 30 and designed to divert a traction element 33 in the form of a cord or line running thereon. This line 33 is on one side of the substantially cone-shaped tent cloth led from the upper end of the tent cloth and downwardly to the lower end thereof in guide members, preferably a channel sewn on the tent cloth or straps, wherein members are arranged to prevent the line from leaving the upper end of the tenth cloth and these members could be formed by the fact that the line is simply secured to said end. When starting to bring the tent cloth in place the first arm 29 of the tool 28 is first of all secured in the position shown in FIG. 5 by connecting an eye arranged close to the outer end thereof with one of the rods 5 through for example a belt. The line part leaving the lower end of the tent cloth is after that brought around the diverting wheel 2 and downwardly towards the ground. It should be pointed out that these movements of the hand may take place before the support arrangement 8 is lifted by pivoting the rods 5. The line 33 is after that pulled in the direction of the arrow pointing downwardly in FIG. 5, by which the line will catch the lower end of the tent cloth by the upper end of the tent cloth thanks to the guide members and in this way pull the tent cloth folded together on the outside of the stand towards the tool 28 (see FIG. 6), said pulling being continued until substantially the entire tent cloth part folded together has been hoisted and bears on the tool 28. A person climbs after that on a ladder or the like up to the region of the tent top and secures the cloth portion folded together by means of a belt or the like to the outer eyes of the tool, whereupon he releases the first arm 29 from the rod 5 and pivots the tool so that the second arm 30 will point downwardly. Said cloth portion is after that loosened from the tool and it may now slide downwardly on the side of the tent top laying directly opposite to the side it was hoisted on. This position is shown in FIG. 7. The tent cloth may after that be slightly pulled so that it through the gravitation slides down in place around the rods 5. The carrying elements 7 (see FIG. 1) may be applied and possible tent pins may be driven into the ground at the lower end of the tent cloth when this has been done. A person may after that through a ladder or the like climb up and remove the tool 28 and apply the flue gas fly 3 and after that a bunch dummy 18.

Disassembling of the tent is preferably started by climbing up to the top, removing the bunch dummy 18 and the flue gas fly 3 and applying the tool 28 in the position shown in FIG. 5, whereupon the line 33 is led around the diverting wheel 32, but now with the line part leaving the upper end of the tent cloth, so that the lower end of the tent cloth will be displaced upwardly towards the tool under folding the tent cloth portion in question together. Tilting of the tool and sliding downwardly of the tent cloth takes place after that in a way corresponding to what has been described in connection with the pitching of the tent. Each end of the line 33 has preferably a member with a greater cross section than the guide members of the tent cloth so as to obtain said function, so that one and the same line may be used for pitching as well as for disassembling.

It appears from above that the tent according to the invention by means of the pitching method according to the invention well may be used for temporary arrangements, even in the case of a so called "giant tent hut" which may take more than 50 persons, since the time consumption for pitching and disassembling is comparatively small.

The invention is of course not in any way restricted to the preferred embodiment described above, but several possibilities to modifications thereof would be apparent to a man skilled in the art without departing from the scope of the invention.

It would for example be possible to have another number of rods, carrying elements and cross bars than shown by the drawings.

The male and female members arranged on the cross bars and the rods, respectively, could of course be replaced by female and male members, respectively, and be designed in other ways, so far as they form members being able to enter into engagement with each other. For example the rigid elements could for example be of the type varying their length in a telescopically or screwably way and arranged to bring the first and second engaging members into and out of their mutual engagement, respectively, by modifying the length of the rigid elements.

The two rings of the support arrangement could be replaced by frames with another shape than circular, the definition "frame" in the claims relating to the fact that it is a question of any endless member extending around and surrounding a greater opening therein, so that it is possible to completely grip around parts of the frame as the ends of the rods do in the embodiment described. The lower support ring could of course be constituted by a continuous plate or the like. It would also be possible to provide the ring 10 with members for making it impossible to displace the rods attached thereto therealong and by that exactly defining the connecting points of the rods.

The bunch dummy could of course be omitted when desired, but it certainly confer a more attractive appearance to the tent according to the invention.

I claim:

1. A substantially cone-shaped tent having a top, said tent comprising:

a plurality of rods connected to each other in the region of the top of the tent, said rods extending divergingly downwardly to a ground surface on which the tent stands, each of said rods forming substantially a generatrix of an imagined cone;

a substantially cone-shaped tent cloth disposed over and supported by the rods;

interconnection means interconnecting adjacent rods at a distance from the top of the tent to hold the rods in a determined mutual position, said interconnection means further comprises a plurality of elongated rigid elements having opposite ends, each of said opposite ends having a first engaging member, each of said rods having second engaging members arranged to enter into engagement with the first engaging members when adjacent rods are interconnected, wherein said interconnection means holds two adjacent rods at a mutual distance defined by the rigid elements; and wherein each of said first engaging means is comprised of a male member extending substantially perpendicular to the longitudinal direction of the rigid element at the respective element end, each of said second engaging members is comprised of a loop-like female member receiving the male member of the rigid element, said female member being secured to a side of the rod facing one of the adjacent rods.

2. A substantially cone-shaped tent having a top, said tent comprising:

a plurality of rods connected to each other in the region of the top of the tent, said rods extending divergingly downwardly to a ground surface on which the tent stands, each of said rods forming substantially a generatrix of an imagined cone;

a substantially cone-shaped tent cloth disposed over and supported by the rods;

interconnection means interconnecting rods at a distance from the top of the tent to hold the rods in a determined mutual position, said interconnection means further comprises a plurality of elongated rigid elements having opposite ends, each of said opposite ends having a first engaging member, each of said rods having second engaging members arranged to enter into engagement with the first engaging members when adjacent rods are interconnected, wherein said interconnection means holds two adjacent rods at a mutual distance defined by the rigid elements; and wherein each rigid element is loosenable from and displaceable with respect to the rods by bringing the first and second engaging members out of their mutual engagement.

3. The tent of claim 2 wherein the first and second engaging members are arranged to enter into mutual engagement by displacements of the rigid elements with respect to the adjacent rods.

4. The tent of claim 3 wherein each of the second engaging members is directed obliquely, outwardly, and upwardly with respect to the rods and extends away from the center of the tent in the position in which the rods are prepared for interconnection, each of said first engaging members is pushed obliquely, inwardly, and downwardly into engagement with one of the second engaging members by displacement of the respective element to thereafter be retained in said engaged position by gravitational force.

5. A substantially cone-shaped tent having a top, said tent comprising:

a plurality of rods connected to each other in the region of the top of the tent, said rods extending divergingly downwardly to a ground surface on which the tent stands, each of said rods forming substantially a generatrix of an imagined cone;

a substantially cone-shaped tent cloth disposed over and supported by the rods;

interconnection means interconnecting adjacent rods at a distance from the top of the tent to hold the rods in a determined mutual position;

a support arrangement in the region of the top of the tent;

a frame connected to the support arrangement, the frame being positioned substantially horizontal and being pivotally connected to the upper end of each of said rods through a plurality of pivot members such that each rod is pivotable substantially about the horizontal tangent at a point of connection between the rod and the frame, the upper ends of the rods also being displaceable along the frame; and a support element rigidly connected to the support arrangement, the support element being disposed below the frame and having an outer circumference adapted to be touched by and to support each rod extending from the frame downwardly towards the ground when the rods are in the determined mutual position.

6. A substantially cone-shaped tent having a top, said tent comprising:

a plurality of rods connected to each other in the region of the top of the tent, said rods extending divergingly downwardly to a ground surface on which the tent stands, each of said rods forming substantially a generatrix of an imagined cone;

a substantially cone-shaped tent cloth disposed over and supported by the rods;

interconnection means interconnecting adjacent rods at a distance from the top of the tent to hold the rods in a determined mutual position;

a cloth hoist tool connected to the top of the tent having an elongated flexible traction element and a diverting member;

said traction element being secured to an upper end of the tent cloth, wherein the upper end of the traction element is unable to leave the upper end of the tent cloth when pulling the traction element from the upper end of the tent cloth towards the lower end of the tent cloth; and wherein said diverting member receives and diverts a part of the traction element leaving the lower end of the tent cloth while hoisting the portion of the tent cloth arriving at the top of the tent first over the top of the tent and down on the opposite side of the tent.

7. A method for pitching a substantially cone-shaped tent comprising the steps of:

providing a support arrangement having a frame rigid disposed near the top of the tent;

providing a plurality of rods each having an upper end;

pivotally connecting the upper end of each rod to the frame such that the upper ends of the rods are displaceable along the frame;

displacing the upper ends of the rods along the frame in a position suitable for a pitched tent;

pivoting the rods with respect to the frame about an axis such that the rods extend divergingly downwardly to a ground surface on which the tent shall stand;

interconnecting adjacent rods at a distance from the top of the tent so as to hold them in a determined mutual position; and applying a substantially cone-shaped tent cloth on the outside of and so that it is supported by the rods.

8. A method for pitching a substantially cone-shaped tent comprising the steps of:

providing a support arrangement having a frame disposed near the top of the tent and a support element disposed below the frame, the support element being positioned to define a degree of divergence from the frame to the support element;

providing a plurality of rods each having an upper end and a lower end;

pivotally connecting the upper end of each rod to the frame such that the upper ends of the rods are displaceable along the frame;

pivoting at least two of the rods that are substantially opposite each other by moving the lower ends of the rods towards each other until the rods abut the support element defining a degree of divergence of the rods;

pivoting the remainder of the rods with respect to the frame such that the rods extend divergingly downwardly to a ground surface on which the tent shall stand;

interconnecting adjacent rods at a distance from the top of the tent so as to hold them in a determined mutual position; and applying a substantially cone-shaped tent cloth on the outside of and so that it is supported by the rods.

9. A method for pitching a substantially cone-shaped tent comprising the steps of:

providing a plurality of rods;

connecting the rods to each other in the region of the top of the tent so that the rods extend divergingly downwardly to a ground surface on which the tent shall stand;

providing a plurality of elongated rigid elements having a first engaging member at each end, each of said rods having at least one second engaging member;

interconnecting adjacent rods at a distance from the top of the tent so as to hold them in a determined mutual position by moving the first engaging members of the rigid elements obliquely from above and outside into engagement with the corresponding second engaging members directed obliquely upwardly and outwardly away from the center of the tent, causing the engagement of the rods while adjusting the distance between the adjacent rods so that the engagement may be obtained; and applying a substantially cone-shaped tent cloth on the outside of and so that the tent cloth is supported by the rods.

10. A method for pitching a substantially cone-shaped tent comprising the steps of:

providing a plurality of rods;

connecting the rods to each other in the region of the top of the tent so that the rods extend divergingly downwardly to a ground surface on which the tent shall stand;

providing a plurality of elongated rigid elements having a first engaging member at each end, each of said rods having at least one second engaging member;

interconnecting adjacent rods at a distance from the top of the tent so as to hold them in a determined mutual position by bringing each first engaging member of the rigid elements into engagement with one of the second engaging members of the rods while adjusting the distance between the adjacent rods so that the engagement may be obtained;

providing a substantially cone-shaped tent cloth having an upper and lower end;

providing a cloth hoist tool having a diverting member and an elongated flexible traction element, said cloth hoist tool being connected to the upper region of the tent;

securing the traction element to the upper end of the tent cloth;

pulling the traction element toward the diverting member wherein the upper end of the traction element is unable to leave the upper end of the tent cloth while pulling the traction element from the upper end of the tent cloth towards the lower end of the tent cloth such that the tent cloth moves on the outside of at least one of the rods towards the top of the tent; and bringing a portion of the tent cloth over the top of the tent and letting the portion down such that the tent cloth is supported by the rods.

11. A method for pitching a substantially cone-shaped tent comprising the steps of:

providing a plurality of rods;

connecting the rods to each other in the region of the top of the tent so that the rods extend divergingly downwardly to a ground surface on which the tent shall stand;

providing a plurality of elongated rigid elements having a first engaging member at each end, each of said rods having at least one second engaging member;

interconnecting adjacent rods at a distance from the top of the tent so as to hold them in a determined mutual position by bringing each first engaging member of the rigid elements into engagement with one of the second engaging members of the rods while adjusting the distance between the adjacent rods so that the engagement may be obtained;

providing a substantially cone-shaped tent cloth having an upper and lower end;

providing a cloth hoist tool comprising:

a double-armed lever pivotally connected about a horizontal axis near the top of the tent, the double-armed lever having a first arm pointing downward substantially parallel with the rods and a second arm opposite the first arm, a diverting member connected to the second arm, and an elongated flexible traction element connected to the diverting member;

securing the traction element to the upper end of the tent cloth;

pulling the traction element toward the diverting member wherein the upper end of the traction element is unable to leave the upper end of the tent cloth while pulling the traction element from the upper end of the tent cloth towards the lower end of the tent cloth such that the tent cloth moves on the outside of at least one of the rods towards the top of the tent until a portion of the tent cloth is on top of the double-armed lever; and pivoting the second arm downwardly and the first arm upwardly such that the portion slides off the double-armed lever downwardly in the direction in which the second arm points such that the cloth is supported by the rods.

* * * * *